US009704366B2

(12) United States Patent
Aswath et al.

(10) Patent No.: US 9,704,366 B2
(45) Date of Patent: Jul. 11, 2017

(54) METHOD TO DETECT AN ALARM SITUATION AND TO SEND SILENT ALERTS TO EXTERNAL SYSTEMS USING VOICE INPUT TO MOBILE DEVICES

(71) Applicant: Honeywell International Inc., Morristown, NJ (US)

(72) Inventors: Ravikumar Vemagal Aswath, Karnataka (IN); Vinay Hegde, Karnataka (IN); Deepak Sundar Meganathan, Karnataka (IN)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 41 days.

(21) Appl. No.: 13/943,261

(22) Filed: Jul. 16, 2013

(65) Prior Publication Data

US 2015/0022347 A1 Jan. 22, 2015

(51) Int. Cl.

| | |
|---|---|
| ***G08B 21/02*** | (2006.01) |
| ***G08B 1/08*** | (2006.01) |
| ***G08B 13/16*** | (2006.01) |
| *G08B 25/01* | (2006.01) |

(52) U.S. Cl.

CPC ..... *G08B 21/02* (2013.01); *G08B 13/1672* (2013.01); *G08B 25/016* (2013.01)

(58) Field of Classification Search

CPC ..... G08B 21/02; G08B 1/08; G08B 25/10; G08B 25/012; G08B 25/016

USPC ..... 340/539.1, 539.11, 506, 540, 541, 573.1, 340/384.7, 5.61; 455/404.1, 414.1, 456, 455/456.1

See application file for complete search history.

(56) References Cited

U.S. PATENT DOCUMENTS

| | | | | |
|---|---|---|---|---|
| 4,897,862 | A * | 1/1990 | Nishihara et al. | 379/40 |
| 6,496,111 | B1 | 12/2002 | Hosack | |
| 7,245,204 | B2 * | 7/2007 | Ramos et al. | 340/426.12 |
| 7,376,565 | B2 * | 5/2008 | Gandhi et al. | 704/274 |
| 7,884,714 | B2 * | 2/2011 | Fein et al. | 340/539.22 |
| 8,264,346 | B2 * | 9/2012 | Petricoin et al. | 340/540 |

(Continued)

FOREIGN PATENT DOCUMENTS

| | | |
|---|---|---|
| DE | 298 08 958 U1 | 8/2000 |
| GB | 2 291 238 A | 1/1996 |

(Continued)

OTHER PUBLICATIONS

Combined Search and Examination Report for corresponding GB patent application 1412025.7, dated Dec. 19, 2014.

(Continued)

*Primary Examiner* — Hung T Nguyen

(74) *Attorney, Agent, or Firm* — Husch Blackwell LLP

(57) ABSTRACT

Disclosed is an apparatus that embodies a method including a panic alert mobile application of a security system that protects a secured geographic area executing on a portable electronic device of an authorized user, the panic alert mobile application retrieving a predetermined word sequence associated with the authorized user, the panic alert mobile application continuously monitoring spoken words of the authorized user, the panic alert mobile application detecting the predetermined word sequence in the spoken words of the authorized user and the panic alert mobile application reporting a panic alert to a central monitoring station of the security system.

22 Claims, 1 Drawing Sheet

(56) References Cited

U.S. PATENT DOCUMENTS

| | | | | |
|---|---|---|---|---|
| 8,461,983 | B2 * | 6/2013 | McCauley | 340/539.13 |
| 9,141,150 | B1 * | 9/2015 | Trundle | G06F 1/1694 |
| 2008/0287109 | A1 * | 11/2008 | Marett et al. | 455/414.1 |
| 2011/0021172 | A1 * | 1/2011 | Ricordi | G06F 19/3418 455/404.1 |
| 2011/0144996 | A1 * | 6/2011 | Ma | G06F 17/2765 704/251 |

FOREIGN PATENT DOCUMENTS

| | | | | |
|---|---|---|---|---|
| GB | 2 298 067 | A | 8/1996 | |
| KR | 20-0446385 | | 10/2009 | |
| WO | WO 2005/079178 | A2 | 9/2005 | |
| WO | WO 2012/141606 | * | 10/2012 | 340/539.11 |

OTHER PUBLICATIONS

ICAP Patent Brokerage, Turn Your Mobile Phone Into a Panic Button. ICAP Patent Brokerage Announces for Auction a Patented Method to Add Important Personal Safety and Security Functionality to Mobile Phones, http://www.prnewswire.com/news-releases/turn-your-mobile-phone-into-a-panic-button-icap-patent-brokerage-announces-for-auction-a-patented-method-to-add-important-personal-safety-and-security-functionality-to-mobile-phones-159445175.html, Jun. 18, 2012.

* cited by examiner

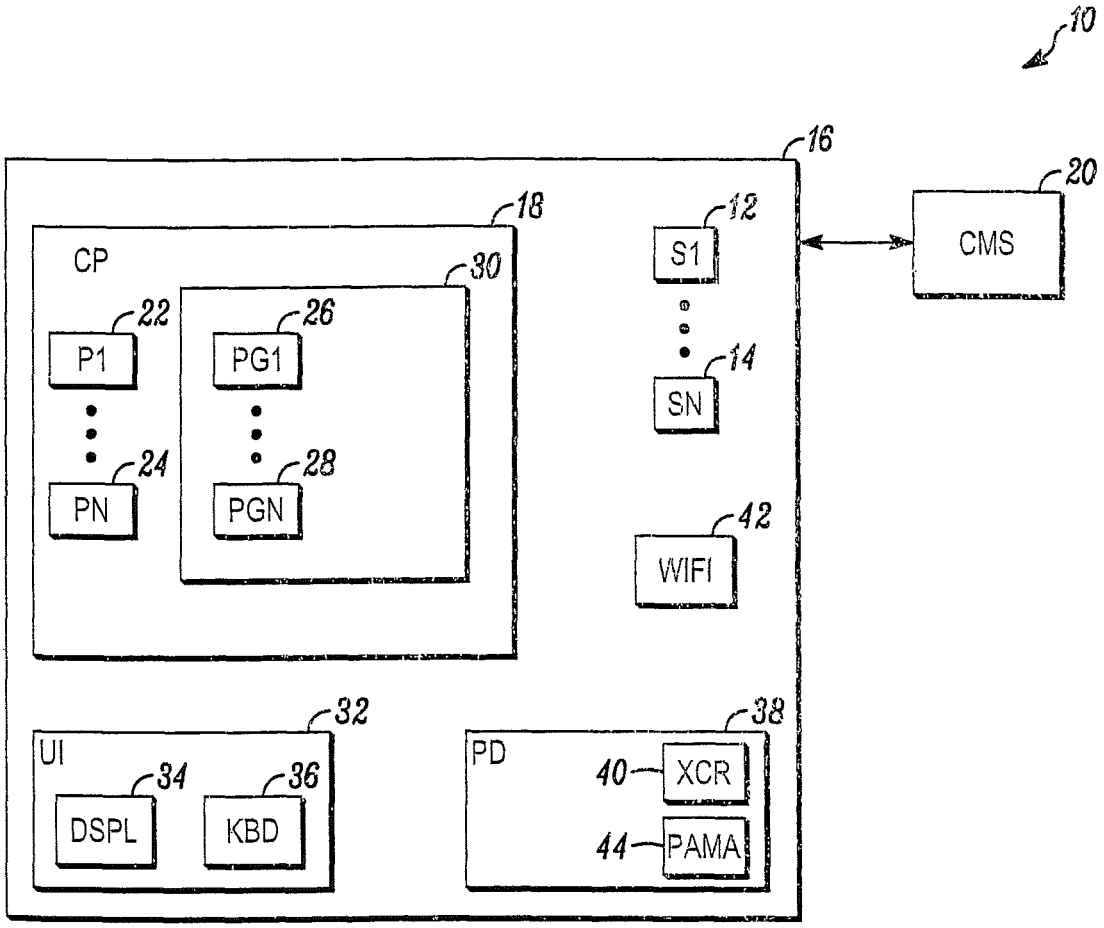
10
16
20
CMS
18
CP
30
22
P1
26
PG1
24
PN
28
PGN
12
S1
14
SN
42
WIFI
32
UI
34
DSPL
36
KBD
38
PD
40
XCR
44
PAMA

METHOD TO DETECT AN ALARM SITUATION AND TO SEND SILENT ALERTS TO EXTERNAL SYSTEMS USING VOICE INPUT TO MOBILE DEVICES

FIELD

The field relates to security systems and, more particularly, to methods of trigging security alerts.

BACKGROUND

Security systems are generally known. Such systems are typically used to protect people and assets within a secured area, such as a home or a business, from any of a number of different threats.

For example, a security system may be arranged to detect threats from unauthorized intruders entering the secured area. Alternatively, the security system may be used to detect environmental threats, such as fires, carbon monoxide, or natural gas leaks.

In many cases, a number of sensors may be distributed throughout the secured area. For example, fire detectors may be provided in hallways or near combustion sources. Similarly, limit switches may be provided on the doors and the windows of the secured area.

A control panel may monitor the status of each sensor. Upon activation of a sensor, the panel may send an alert to a central monitoring station. The central monitoring station may respond by alerting the police or the fire department.

While security systems work well, they may not be able to protect an occupant from an intruder who has entered a secured area without tripping a sensor. Accordingly, a need exists for better methods of protecting occupants.

BRIEF DESCRIPTION OF THE DRAWING

FIG. 1 is a block diagram of a security system shown generally in accordance with an illustrated embodiment.

DETAILED DESCRIPTION OF AN ILLUSTRATED EMBODIMENT

While embodiments can take many different forms, specific embodiments thereof are shown in the drawings and will be described herein in detail with the understanding that the present disclosure is to be considered as an exemplification of the principles hereof as well as the best mode of practicing the same. No limitation to the specific embodiment illustrated is intended.

FIG. 1 depicts a security system 10 shown generally in accordance with an illustrated embodiment. Included within the security system may be a number of sensors 12, 14 that detect threats within a secured area 16. The sensors may each be constructed to detect different threats. For example, some of the sensors may be limit switches located on doors and windows located along the perimeter of the secured area that are activated by entry of an intruder into the secured area. Other sensors may be fire, carbon monoxide, or natural gas detectors. Still others may be motion detectors that detect intruders who have been able to avoid detection by the perimeter sensors.

Also included within the secured area may be a control panel 18 that monitors each of the sensors. Upon activation of one of the sensors, the control panel may send an alarm message to a central monitoring station 20. The alarm message may be sent to the central monitoring station via an Internet connection, a general public radio system (GPRS), or any wired or wireless communication or cloud platform that supports a connection between the resources of the local security system and the central monitoring station. The central monitoring station may respond by dispatching the police or the fire department.

The control panel may contain a number of control resources, including one or more processor apparatuses (processors) 22, 24 executing one or more computer programs 26, 28 loaded from a non-transient computer readable medium (memory) 30. As used herein, reference to a step performed by a program is also reference to the processor that executed that step.

During operation of the security system, an alarm processor may monitor the status of each of the sensors. Upon detecting activation of one of the sensors, the alarm processor may compose an alarm message and send that alarm message to the central monitoring station. The alarm message may include an identifier of the security system (e.g., an address, an account number, etc.), an identifier of the sensor, a type of sensor, and a time. The central monitoring station may respond by dispatching the appropriate help (e.g., police, firemen, etc.).

The security system may be controlled via a user interface 32. The user interface may be incorporated into the control panel.

The user interface, in turn, may include a display 34 that shows a status of the security system. The display may also be a touch sensitive device that accepts inputs from an authorized user, or the user interface may include a separate keyboard 36 that receives inputs from the user.

During normal use, the authorized user may arm and disarm the security system through the user interface. In this regard, the user may enter a personal identification number (PIN) and activate one of a number of function keys on the interface. For example, the user may enter his/her identifier and activate an "arm" or "arm away" button to arm the security system. Alternatively, the user may enter his/her identifier followed by activation of the "disarm" button to disarm the system.

The user interface may also be implemented on a portable user device 38 (e.g., a smartphone) carried by the authorized user as one or more applications 26, 28 executing on one or more processors 22, 24 of the portable user device. In this regard, the portable user device may exchange wireless signals with the control panel via a transceiver 40 and a wireless access point 42 within the secured area under an appropriate communication protocol (e.g., IEEE 802.11). In this case, an interface processor within the control panel may download an interface screen to the portable user device that mimics the operation of the user interface 32 on the display screen and the keyboard of the portable user device. Using the interface screen on the portable user device, the user may enter his/her PIN and control the operation of the security system.

Alternatively, the portable user device may form a connection with the control panel remotely via the Internet. As above, the interface processor may authenticate the user via an entered PIN number and execute commands entered through the portable user device.

Alternatively or in addition, the portable user device 38 is provided with a panic alert mobile application 44 that executes in the background on one of the processor apparatuses of the portable mobile device. In this regard, the panic application monitors a voice of the authorized user for a verbal code indicating that the user has been threatened. Once the verbal code has been detected, the panic alert application may send a silent alarm or a panic alert to the central monitoring station through the control resources of the secured area.

In this regard, the verbal code is a string of words that would not normally be used in conversation by the user. The user, in fact, may save a number of respective voice strings in a memory of the portable device that each represents and would be appropriate for a particular threat situation.

In this regard, the use of codes based upon any of a number of word strings offers a number of advantages of prior methods. For example, if the authorized user is being held by an intruder at gunpoint, then the user would not be able to trigger a panic alarm through the user interface of his/her home security system.

Alternatively, if the intruder disables the security system, ambushes the user, and has the user at gunpoint, then the panic alert application may still operate to achieve its intended objectives. In this regard, the panic alert application may detect the malfunctioning or non-functioning security system and send an alert directly to the central monitoring station through a cellular or Internet interface normally available within the portable device.

In addition, operation of the panic alert application is not dependent upon who has possession of the portable electronic device. In this regard, the intruder could demand and receive the portable electronic device from the user before the user is able to verbally provide the appropriate code words. In this case, the programmed processor executing the panic alert application sends the alert to the central monitoring station while in the possession of the intruder.

In general, the panic alert application comprises a number of programs executing on the same or different processors. One of those programs is a word recognition processor that uses natural language processing to recognize any spoken words. Another processor is an authentication processor that authenticates the user. Still another may be a set-up processor that is activated by the user to record word strings for generating panic alarms. A monitoring processor may combine and coordinate other processors in order to detect and generate panic alerts.

In this regard, the set-up processor of the portable electronic device may be activated via the authorized user entering a PIN and a set up function through a user interface of the portable electronic device. The user may then verbally provide one or more word sequences through a microphone on the portable electronic device. The provided words may be processed by the word recognition processor and the authentication processor. In this regard, the word processor may identify the provided words before entry into the corresponding verbal code file. Examples of word codes could include "take everything except my mobile" or "hey, it's my friend Jack's mobile." In addition, the authentication processor and an associated Fourier processor may process the verbal content of each word of the provided words to obtain a set of voice biometrics of each of the spoken words. Voice biometrics, in this case, include the frequency content obtained as a time profile in the expression of each word. This frequency profile is associated with the particular word spoken, is used as a unique signature of the user for that word, and can be later used to differentiate between the authorized user and some other person speaking that same word. As the user provides each word code during set-up, the recognized word and the word signature are saved by the set-up processor in a respective code word file of the portable electronic device.

During normal use, the monitoring processor operates in the background, consuming very little power as it monitors for code words. As each verbal expression is detected, the word processor identifies the word, and the authentication processor attempts to match the verbal metrics of the word recognized by the word processor with the verbal metrics of the authorized user speaking that same word.

By recognizing each word and matching the verbal metrics with each word, the monitoring processor is able to isolate words spoken by the authorized user from a conversation involving other persons proximate the portable electronic device. This avoids the possibility of false alarms caused by the random juxtaposition of words from many people engaging in normal conversation.

As the monitoring processor receives each word from the word recognition processor, the word is added to a code hypothesis string that is then compared with the contents of each code word file. Words spoken by the authorized user are added to the string. Words spoken by other persons are simply deleted. The most recent word spoken by the user is added to the front of the string. Older words may be deleted from the end based upon the time window used.

Whenever a match is found between a sequence of words spoken by the authorized user and a code file, a notification is sent to an alert processor. The alert processor may compose an alert message and transfer the alert to the central monitoring station through the alarm panel or directly to the central monitoring station if the control panel has been disabled. The central monitoring processor may respond by summoning the police.

In another embodiment, the system may include multiple portable electronic devices independently used by respective authorized users. In this case, the respective set-up processor may save separate word code files for each authorized user in each respective device or may save them in the memory of the control panel and download the word code files of each authorized user into the respective portable electronic device during startup. In each case, whenever the portable electronic device detects a match between a word code file and the spoken words of an authorized user, the device sends a panic alert to the central monitoring station. The alert may include an identification of the security system, an identifier of the portable electronic device, an identifier of the authorized user, and a time of the alert.

In another embodiment, the panic alert is sent to the mobile devices of family or friends of the authorized user. In this case, the alert may be forwarded by the central monitoring station. Alternatively, the alert may be forwarded directly from the portable electronic device of the authorized user.

In another embodiment, the panic alert mobile application is loaded onto any wearable device, sensor, or computer that has the ability to receive and process voice and to transmit wireless signals.

In another embodiment, the processor executing the panic alert mobile application reports a panic alert to the central monitoring station without any visual or audible indication emitted from the mobile device so that an intruder does not notice the communication.

In general, the system may include a panic alert mobile application of a security system that protects a secured geographic area executing on a portable electronic device of an authorized user, the panic alert mobile application retrieving a predetermined word sequence associated with the authorized user, the panic alert mobile application continuously monitoring spoken words of the authorized user, the panic alert mobile application detecting the predetermined word sequence in the spoken words of the authorized user, and the panic alert mobile application reporting a panic alert to a central monitoring station of the security system.

The system may include a central monitoring station that protects a secured area via a local security system, and a portable electronic device of an authorized user of the local security system, wherein the portable electronic device executes a panic alert mobile application of the local security system, and wherein the panic alert mobile application continuously monitors for spoken words of the authorized user, detects a predetermined word sequence in the spoken words, and reports a panic alert to the central monitoring station of the local security system in response to detecting the predetermined word sequence.

Alternatively, the system may include a security system that protects a secured area, a central monitoring station that receives alarm messages from the security system and a portable electronic device of at least one authorized user of the security system, wherein the portable electronic device executes a panic alert mobile application of the security system, and wherein a processor of the panic alert mobile application saves at least one word sequence from the at least one authorized user, continuously monitors for spoken words of the at least one authorized user, detects a first word sequence in the spoken words that matches the at least one word sequence, and reports a panic alert to the central monitoring station of the security system in response to detecting a match.

From the foregoing, it will be observed that numerous variations and modifications may be effected without departing from the spirit and scope hereof. It is to be understood that no limitation with respect to the specific apparatus illustrated herein is intended or should be inferred. It is, of course, intended to cover by the appended claims all such modifications as fall within the scope of the claims.

The invention claimed is:

1. A method comprising:

a panic alert mobile application executing on a portable or wearable electronic device of an authorized user;

the panic alert mobile application retrieving a word sequence associated with the authorized user from a memory wherein the word sequence comprises a string of words that would not normally be used in conversation by the authorized user;

the panic alert mobile application continuously monitoring spoken words of the authorized user;

the panic alert mobile application matching one of the spoken words detected by the panic alert mobile application with verbal metrics of the authorized user to determine whether the authorized user spoke the one of the spoken words;

the panic alert mobile application adding the one of the spoken words to a temporary string when the panic alert mobile application determines that the one of the spoken words was spoken by the authorized user;

the panic alert mobile application detecting the word sequence spoken by the authorized user when the temporary string matches the word sequence; and the panic alert mobile application reporting a panic alert to a central monitoring station of the security system in response to detecting the word sequence.

2. The method as in claim 1 further comprising a control panel of a security system that protects a secured area reporting the panic alert to the central monitoring station via an Internet connection, GPRS, or any other wired or wireless communication.

3. The method as in claim 2 further comprising a wireless access point within the secured area receiving the panic alert and forwarding the panic alert to the control panel.

4. The method as in claim 1 wherein the verbal metrics comprise a voice signature of the authorized user.

5. The method as in claim 1 further comprising the panic alert mobile application entering a learning mode, receiving the word sequence from the authorized user, and saving the word sequence in the memory.

6. The method as in claim 5 further comprising saving a plurality of word sequences for each of a plurality of authorized users.

7. The method as in claim 1 further comprising the panic alert mobile application reporting the panic alert to a family member or a friend of the authorized user.

8. An apparatus comprising:

a central monitoring station that protects a secured area via a local security system; and a portable or wearable electronic device of an authorized user of the local security system, wherein the portable or wearable electronic device executes a panic alert mobile application of the local security system, wherein the panic alert mobile application continuously monitors for spoken words of the authorized user for a word sequence including a string of words that would not normally be used in conversation by the authorized user, and wherein the panic alert mobile application matches one of the spoken words detected by the panic alert mobile application with verbal metrics of the authorized user to determine whether the authorized user spoke the one of the spoken words, adds the one of the spoken words to a temporary string when the panic alert mobile application determines that the one of the spoken words was spoken by the authorized user, detects the word sequence when the temporary string matches the word sequence, and reports a panic alert to the central monitoring station of the local security system in response to detecting the word sequence.

9. The apparatus as in claim 8 further comprising a wireless access point within the secured area that receives the panic alert.

10. The apparatus as in claim 9 further comprising a control panel within the secured area that receives the panic alert from the wireless access point and reports the panic alert to the central monitoring station via an Internet connection, GPRS, or any other wired or wireless communication.

11. The apparatus as in claim 10 further comprising a processor of the portable or wearable electronic device that detects a malfunction or a non-functioning of the control panel and forwards the panic alert directly to the central monitoring station.

12. The apparatus as in claim 8 further comprising an authentication processor of the portable or wearable electronic device that authenticates the one of the spoken words as being from the authorized user based on a voice signature of the authorized user.

13. The apparatus as in claim 8 further comprising a set-up processor that enters a learning mode, receives the word sequence from the authorized user, and saves the word sequence in a memory.

14. The apparatus as in claim 13 wherein the set-up processor saves a respective plurality of word sequences for each of a plurality of authorized users in the memory.

15. An apparatus comprising:

a security system that protects a secured area;

a central monitoring station that receives alarm messages from the security system; and a portable electronic device of an authorized user of the security system, wherein the portable electronic device executes a panic alert mobile application of the security system, and wherein a first processor of the panic alert mobile application saves a word sequence from the authorized user including a string of words that would not normally be used in conversation by the authorized user, continuously monitors for spoken words of the authorized user, matches one of the spoken words detected by the panic alert mobile application with verbal metrics of the authorized user to determine whether the authorized user spoke the one of the spoken words, adds the one of the spoken words to a temporary string when the panic alert mobile application determines that the one of the spoken words was spoken by the authorized user, detects the word sequence when the temporary string matches the word sequence, and reports a panic alert to the central monitoring station of the security system in response to detecting the word sequence.

16. The apparatus as in claim 15 wherein the portable electronic device comprises a smart phone.

17. The apparatus as in claim 15 wherein the portable electronic device comprises a wearable device.

18. The apparatus as in claim 15 further comprising a wireless access point within the secured area that receives the panic alert.

19. The apparatus as in claim 18 further comprising a control panel within the secured area that receives the panic alert from the wireless access point and reports the panic alert to the central monitoring station via an Internet connection.

20. The apparatus as in claim 19 wherein the first processor of the panic alert mobile application detects a malfunction or a non-functioning of the control panel and forwards the panic alert directly to the central monitoring station.

21. The apparatus as in claim 15 further comprising an authentication processor of the portable electronic device that authenticates the one of the spoken words as being from the authorized user based on a voice signature of the authorized user.

22. The apparatus as in claim 15 wherein the first processor saves a respective plurality of word sequences for each of a plurality of authorized users in a memory.

* * * * *